US010264933B2

(12) United States Patent
Ren

(10) Patent No.: US 10,264,933 B2
(45) Date of Patent: Apr. 23, 2019

(54) TOILET CONVENIENT TO ASSEMBLE AND DISASSEMBLE

(71) Applicant: XIAMEN BEEWILL SANITARY CO., LTD., Fujian (CN)

(72) Inventor: Shisong Ren, Fujian (CN)

(73) Assignee: XIAMEN BEEWILL SANITARY CO., LTD., Fujian (CN)

( * ) Notice: Subject to any disclaimer, the term of this patent is extended or adjusted under 35 U.S.C. 154(b) by 0 days.

(21) Appl. No.: 15/354,840

(22) Filed: Nov. 17, 2016

(65) Prior Publication Data

US 2017/0065135 A1 Mar. 9, 2017

Related U.S. Application Data

(63) Continuation of application No. PCT/CN2015/081287, filed on Jun. 11, 2015.

(30) Foreign Application Priority Data

Jun. 17, 2014 (CN) ..... 2014 2 0321366 U
Dec. 29, 2014 (CN) ..... 2014 2 0620885 U

(51) Int. Cl.
*A47K 13/00* (2006.01)
*A47K 13/26* (2006.01)
*A47K 13/12* (2006.01)

(52) U.S. Cl.
CPC ..... *A47K 13/26* (2013.01); *A47K 13/12* (2013.01)

(58) Field of Classification Search
CPC ..... A47K 13/12; A47K 13/26
USPC ..... 4/234
See application file for complete search history.

(56) References Cited

U.S. PATENT DOCUMENTS

2008/0172780 A1 7/2008 Shiau
2011/0067170 A1 3/2011 Greenspon
2012/0284909 A1* 11/2012 Chen ..... A47K 13/12 4/240
2013/0333104 A1* 12/2013 Hong ..... A47K 13/12 4/236
2016/0157685 A1* 6/2016 Shi ..... A47K 13/26 4/236

(Continued)

FOREIGN PATENT DOCUMENTS

CN 202821175 U 3/2013
CN 202981847 6/2013

(Continued)

*Primary Examiner* — Huyen Le
(74) *Attorney, Agent, or Firm* — Leason Ellis LLP

(57) ABSTRACT

A toilet convenient to assemble and disassemble includes a toilet body (10) of which the upper end is provided with a supporting seat (30) and a toilet cover plate (20) of which the rear end is provided with a pivot shaft (40), wherein the supporting seat (30) is provided with an embedding hole (31) and the pivot shaft (40) is provided with an inserting column (41), the inserting column (41) being embedded into the embedding hole (31). In this way, whether the inserting column (41) is aligned to the embedding hole (31) or not can be seen clearly during the installation process, thereby the inserting column (41) may be directly aligned and embedded, thus, the operation is very convenient, blind installation is avoided and the installation efficiency is obviously improved.

4 Claims, 3 Drawing Sheets

(56) References Cited

U.S. PATENT DOCUMENTS

| | | | | |
|---|---|---|---|---|
| 2017/0049381 | A1* | 2/2017 | Lieber | A61B 5/4519 |
| 2017/0320270 | A1* | 11/2017 | Mandel | B29C 64/268 |

FOREIGN PATENT DOCUMENTS

| | | |
|---|---|---|
| CN | 203000783 | 6/2013 |
| WO | WO 2012/162957 A1 | 6/2012 |

* cited by examiner

TOILET CONVENIENT TO ASSEMBLE AND DISASSEMBLE

CROSS-REFERENCE TO RELATED APPLICATIONS

This application is a Continuation of International Patent Application No. PCT/CN2015/081287, filed Jun. 11, 2015 and claims the benefit of Chinese Patent Application Nos. 201420321366.4, filed Jun. 17, 2014 and 201420860885.8, filed Dec. 29, 2014, all of which are incorporated by reference in their entireties. The International Application was published in Chinese on Dec. 23, 2015 as International Publication No. WO 2015/192736 A1.

TECHNICAL FIELD

The disclosure relates to bathroom equipment, and in particular to a toilet convenient to assemble and disassemble.

BACKGROUND

At present, there is a variety of installation structures for toilet cover plates; generally, the installation structure includes a supporting seat and a pivot shaft; the supporting seat is fixedly connected with the upper end of a toilet body, and the pivot shaft is connected with the rear end of a toilet cover plate; the supporting seat is fixed on the toilet body in advance; an inserting column is arranged on the supporting seat and an embedding hole is arranged on a connection shaft of the toilet cover plate; however, during the installation process, whether the inserting column is aligned to the embedding hole or not cannot be clearly seen, and it is needed to blindly install by feeling, with a low installation efficiency.

SUMMARY

The disclosure aims to provide a toilet convenient to assemble and disassemble, for solving the problems of blind installation and low efficiency during the installation process of a toilet cover plate in existing technologies.

In order to solve the above technical problem, the technical scheme of the disclosure is: providing a toilet convenient to assemble and disassemble, including a toilet body of which the upper end is provided with a supporting seat and a toilet cover plate of which the rear end is provided with a pivot shaft, wherein the supporting seat is provided with an embedding hole and the pivot shaft is provided with an inserting column, the inserting column being embedded into the embedding hole.

Optionally, the pivot shaft includes an axial damper arranged horizontally, a connector coaxially connected with the axial damper, a locking component, and a shell body arranged to place the connector and the locking component, the inserting column is arranged on the connector vertically and penetrates out from the shell body, and the inserting column is locked and secured in the embedding hole through the locking component.

Optionally, the locking component includes a locking button and an elastic element, a first clamping groove is arranged on the top of the connector horizontally, a clamping hook capable of being clamped in the first clamping groove is arranged on the top of the locking button horizontally, a slot is arranged on the bottom of the connector horizontally, a leg extending into the slot is arranged on the bottom of the locking button horizontally, a through hole is arranged on the leg vertically, the inserting column extends out from the through hole, a convex column is arranged on the supporting seat, the embedding hole is arranged on the convex column, a second clamping groove is arranged on the convex column circularly, the edge of the through hole near the axial damper is clamped in the second clamping groove, and the elastic element is arranged between the connector and the locking button.

Optionally, a first slope is circularly arranged on the top of the convex column and above the first clamping groove, and the edge of the through hole near the axial damper is provided with a second slope sliding fit with the first slope.

Optionally, a mounting hole is arranged at one end of the connector far away from the axial damper, one end of the locking button is inserted into the mounting hole, the other end of the locking button penetrates the shell body, a mounting column is arranged at the center of the mounting hole convexly, a fixed hole corresponding to the mounting column is arranged at one end of the locking button located in the mounting hole, one end of the elastic element is sleeved in the mounting column and the other end of the elastic element is placed in the fixed hole.

Optionally, the elastic element is a spring.

Optionally, the locking component includes an elastic element, a fastener, a plug and a button, the fastener is sleeved on the connector, the plug is fixed at one end of the connector far away from the axial damper, a first clamping groove is arranged on the top of the plug horizontally, a clamping hook capable of horizontally moving to be clamped in the first clamping groove is arranged on the top of the button, an opening is arranged on the bottom of the fastener, the inserting column extends out from the opening, a convex column is arranged on the supporting seat, the embedding hole is arranged on the convex column, a second clamping groove is arranged on the convex column circularly, the edge of the opening near the axial damper is clamped in the second clamping groove, the elastic element is arranged near the axial damper, and the elastic element is elastically pressed between the connecter and the fastener.

Optionally, a first slope is circularly arranged on the top of the convex column and above the first clamping groove, and the edge of the opening near the axial damper is provided with a second slope sliding fit with the first slope.

Optionally, a step is arranged at one end of the connector near the axial damper, one end of the elastic element presses against the step and the other end of the elastic element presses against one end of the fastener.

Optionally, the elastic element is a spring.

In the disclosure, whether the inserting column is aligned to the embedding hole or not can be seen clearly during the installation process, thereby the inserting column may be directly aligned and embedded, thus, the operation is very convenient, blind installation is avoided and the installation efficiency is obviously improved.

10 represents a toilet body, 20 represents a toilet cover plate, 30 represents a supporting seat, 31 represents an embedding hole, 32 represents a convex column, 321 represents a second clamping groove, 322 represents a first slope, 40 represents a pivot shaft, 41 represents an inserting column, 42 represents an axial damper, 43 represents a connector, 431 represents a first clamping groove, 432 represents a slot, 433 represents a mounting hole, 434 represents a mounting column, 44 represents a shell body, 45 represents a locking button, 451 represents a clamping hook, 452 represents a leg, 453 represents a through hole, 454 represents a second slope, 455 represents a fixed hole, 46 represents an elastic element, 47 represents a fastener, 471 represents an opening, 48 represents a plug, and 49 represents a button.

DESCRIPTION OF THE EMBODIMENTS

To make the purpose, technical scheme and benefits of the disclosure more apparent and understandable, a further detailed description is provided to the disclosure in conjunction with the drawings and embodiments. It should be understood that specific embodiments described hereinafter are simply to illustrate the disclosure, but to limit the disclosure.

It should be noted that, when a component is called to be fixed or arranged on another component, the component may be directly on the another component or probably they both have an intermediate component. When a component is called to be connected to another component, it may be directly connected to the another element or probably they both have an intermediate component.

It should also be noted that, directional terms mentioned in the embodiment, such as "left", "right", "upper", "lower", etc., are only mutual relative concepts or used with reference to the normal usage state of the product, but considered as restrictive.

Example 1

Figure 1:
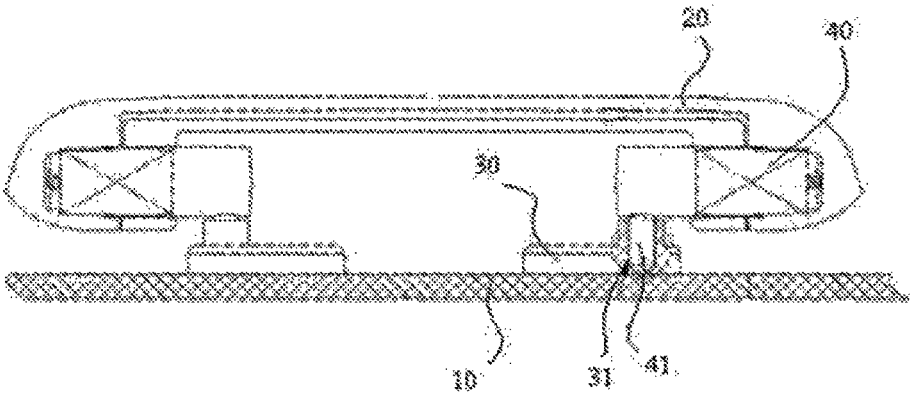
FIG. 1 is an installation sectional view of a toilet body and a toilet cover plate provided by an Example 1 of the disclosure.

Refer to FIG. 1, the first example of the disclosure provides a toilet convenient to assemble and disassemble, including a toilet body 10 of which the upper end is provided with a supporting seat 30 and a toilet cover plate 20 of which the rear end is provided with a pivot shaft 40, wherein the supporting seat 30 is provided with an embedding hole 31 and the pivot shaft 40 is provided with an inserting column 41, the inserting column 41 being embedded into the embedding hole 31. In this example, the toilet has two sets of matched supporting seats 30 and pivot shafts 40; through the two matched structures of supporting seats 30 and pivot shafts 40, the toilet cover plate 20 is fixed on the toilet body 10. In this example, whether the inserting column 41 is aligned to the embedding hole 31 or not can be seen clearly during the installation process, thereby the inserting column 41 may be directly aligned and embedded, thus, the operation is very convenient, blind installation is avoided and the installation efficiency is obviously improved.

Example 2

Figure 2:
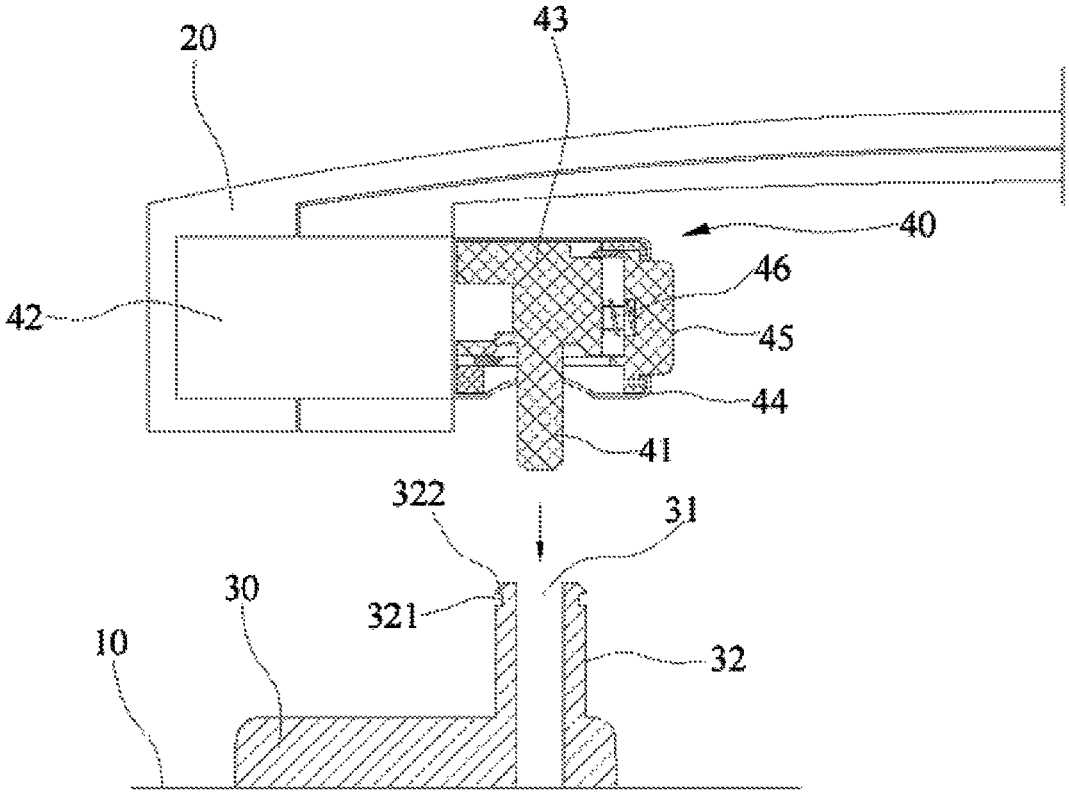
FIG. 2 is a partial sectional exploded view of a toilet body and a toilet cover plate provided by an Example 2 of the disclosure.

Refer to FIG. 2, in this example, a locking structure is provided between the pivot shaft 40 and the supporting seat 30, thereby ensuring reliable and stable lock between the toilet cover plate 20 and the toilet body 10 after installation, and preventing the fall off of the toilet cover plate 20; meanwhile, the locking structure is convenient for unlocking and taking down the toilet cover plate 20.

Figure 3:
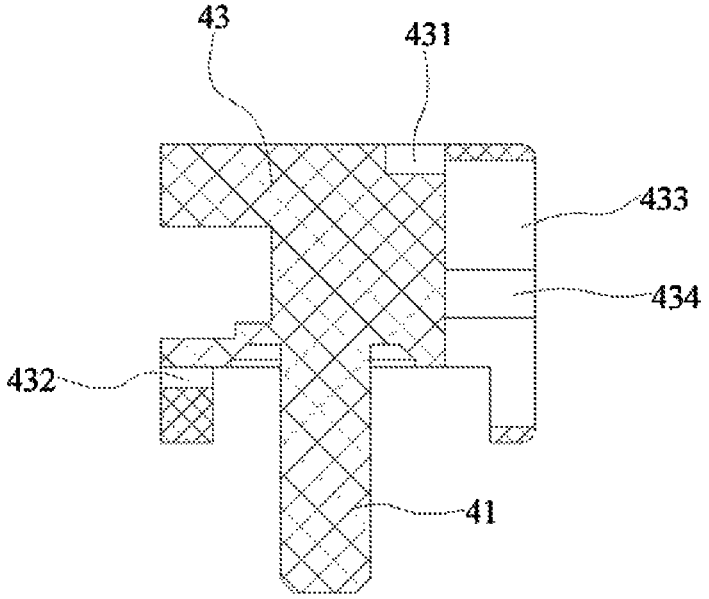
FIG. 3 is a sectional view of a connector in the Example 2 of the disclosure.
Figure 4:
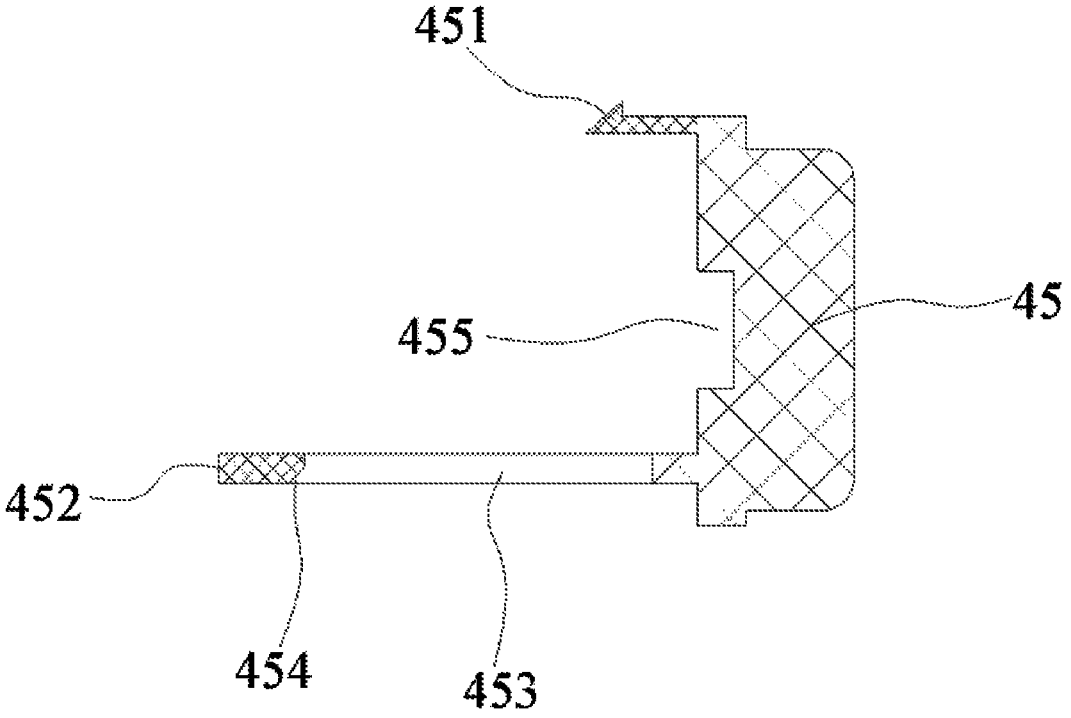
FIG. 4 is a sectional view of a locking button in the Example 2 of the disclosure.

In particular, refer to FIG. 2 to FIG. 4, the pivot shaft 40 includes an axial damper 42 arranged horizontally, a connector 43 coaxially connected with the axial damper 42, a locking component, and a shell body 44 arranged to place the connector 43 and the locking component. Here, the shell body 44 is arranged to accommodate each part and play a role in decoration, avoiding the exposure of the connector 43 and the locking component that is easy to result in failure. The inserting column 41 is arranged on the connector 43 vertically and penetrates out from the shell body 44, and the inserting column 41 is locked and secured in the embedding hole 31 through the locking component.

The locking component includes a locking button 45 and an elastic element 46. The connector 43 is in an axial shape and is placed horizontally. A first clamping groove 431 is arranged on the top of the connector 43 axially, a slot 432 is arranged on the bottom of the connector 43 horizontally, and the inserting column 41 extends out from the bottom of the connector 43. The locking button 45 is arranged horizontally, a clamping hook 451 capable of being clamped in the first clamping groove 431 is arranged on the top of the locking button 45 horizontally, a leg 452 extending into the slot 432 is arranged on the bottom of the locking button 45 horizontally, a through hole 453 is arranged on the leg 452 vertically, the inserting column 41 extends out from the through hole 453, wherein the through hole 453 is arranged for the inserting column 41 to extend out. A convex column 32 is arranged on the supporting seat 30, the embedding hole 31 is arranged on the convex column 32, a second clamping groove 321 is arranged on the convex column 32 circularly, and the edge of the through hole 453 near the axial damper 42 is clamped in the second clamping groove 321. When the inserting column 41 extends into the embedding hole 31, the convex column 32 also extends into the through hole 453, and the second clamping groove 321 is clamped with the edge of the through hole 453 near the axial damper 42; in this way, the convex column 32 is fixedly connected with the inserting column 41, and the inserting column 41 will not fall out from the embedding hole 31. In this example, the elastic element 46 is arranged between the connector 43 and the locking button 45. When the inserting column 41 and the convex column 32 are in a locked state, the elastic element 46 is in a release state, and the elastic element 46 presses against the locking button 45 so that the clamping hook 451 and the first clamping groove 431 of the connector 43 are also in a clamping state; when it is needed to unlock, push the locking button 45 horizontally, so that the elastic element 46 is compressed, the leg 452 of the locking button 45 moves towards the axial damper 42, and the edge of the through hole 453 near the axial damper 42 leaves the second clamping groove 321, thus, unlock between the inserting column 41 and the convex column 32 is completed, and the inserting column 41 can be pulled out from the embedding hole 31, at this time the clamping hook 451 and the first clamping groove 431 are in a loosen state; when the locking button 45 is released, the elastic element 46 is reset to continue pushing against the locking button 45, then the clamping hook 451 and the first clamping groove 431 are clamped together again, thereby preventing the fall off of the locking button 45 from the connector 43.

In this example, a first slope 322 is circularly arranged on the top of the convex column 32 and above the second clamping groove 321, and the edge of the through hole 453 near the axial damper 42 is provided with a second slope 454 sliding fit with the first slope 322. When inserting the inserting column 41 into the convex column 32, the edge of the through hole 453 near the axial damper 42 contacts and slides against the top of the convex column 32; with the two slopes arranged here, the sliding fit is more smooth, without resistance, and it is more laborsaving to insert the inserting column 41.

In this example, the installation structure of the elastic element 46 is: a mounting hole 433 is arranged at one end of the connector 43 far away from the axial damper 42, wherein the mounting hole 433 is communicated with the first clamping groove 431, and a mounting column 434 is arranged at the center of the mounting hole 433 convexly. One end of the locking button 45 is inserted into the mounting hole 433, the clamping hook 451 of the locking button 45 extends into the first clamping groove 431 via the mounting hole 433, the other end of the locking button 45 penetrates the shell body horizontally to be pressed during operation. A fixed hole 455 corresponding to the mounting column 434 is arranged at one end of the locking button 45 located in the mounting hole 433, one end of the elastic element 46 is sleeved in the mounting column 434 and the other end of the elastic element 46 is placed in the fixed hole 455. That is to say, the elastic element 46 is fixed between the connector 43 and the locking button 45.

Preferably, the elastic element 46 is a spring. As spring has good elasticity, when the locking button 45 is pressed, the spring is easy to be compressed; when the locking button 45 is released, the spring has good reset capability.

In this example, when inserting the toilet cover plate 20, insert the inserting columns 41 on two sets of pivot shafts 40 into the embedding holes 31 of the corresponding convex columns 32 downwards respectively; when the inserting column is inserted into a proper location, the edge of the through hole 453 of each locking button 45 near the axial damper 42 is clamped in the second clamping groove 321, then the toilet cover plate 20 can be reliably secured on the toilet body 10. When it is needed to disassemble the toilet cover plate 20, press the locking buttons 45 on the two sets of pivot shafts 40 respectively, then the locking button 45 moves so that the edge of the through hole 453 of each locking button 45 near the axial damper 42 leaves the second clamping groove 321, then it is only needed to lift up the toilet cover plate 20, with convenient disassembly.

Example 3

Figure 5:
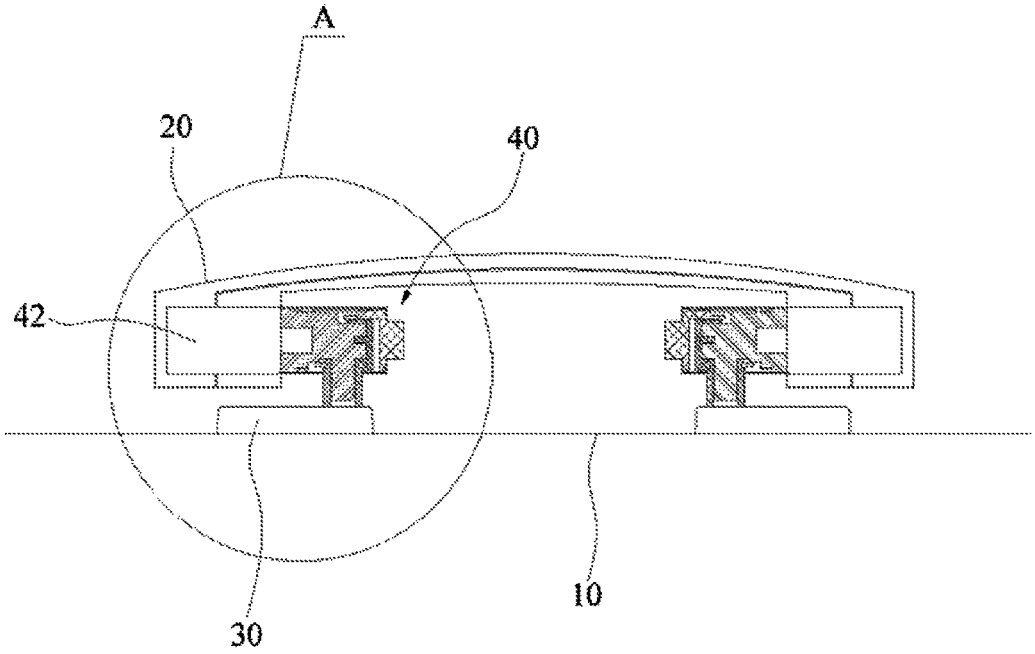
FIG. 5 is an installation sectional view of a toilet body and a toilet cover plate provided by the Example 2 of the disclosure.
Figure 6:
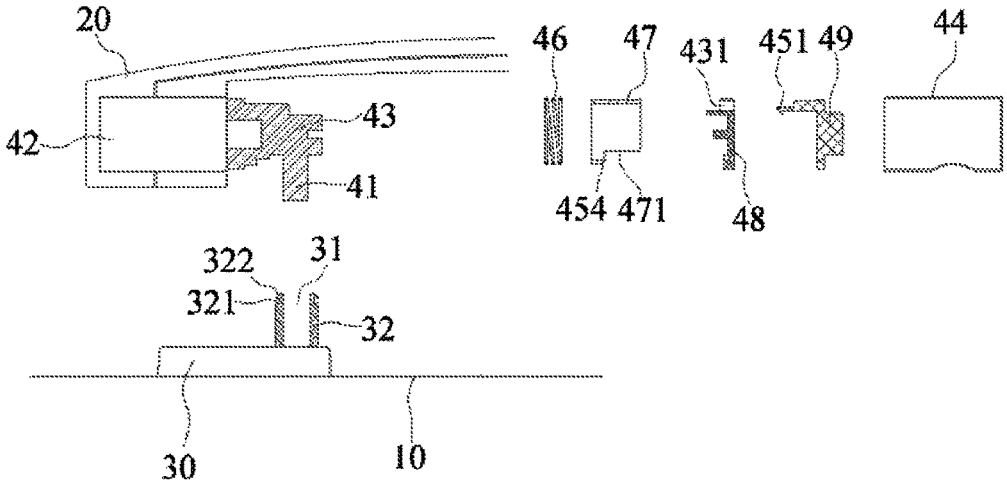
FIG. 6 is an exploded view of a part A in FIG. 5.

Refer to FIG. 5 and FIG. 6, a toilet convenient to assemble and disassemble provided by the third Example of the disclosure is similar to that provided in the Example 2, and the difference is that the locking structure is different; in the Example 2, the connector 43 and the locking button 45 are of a one-piece structure, which is simpler, more stable and reliable to work and lower in cost.

In particular, in the Example 3, the locking component includes an elastic element 46, a fastener 47, a plug 48 and a button 49, wherein the fastener 47 is sleeved on the connector 43, the plug 48 is fixed at one end of the connector 43 far away from the axial damper 42, a first clamping groove 431 is arranged on the top of the plug 48 horizontally, a clamping hook 451 capable of horizontally moving to be clamped in the first clamping groove 431 is arranged on the top of the button 49, an opening 471 is arranged on the bottom of the fastener 47, the inserting column 41 extends out from the opening 471, a convex column 32 is arranged on the supporting seat 30, the embedding hole 31 is arranged on the convex column 32, a second clamping groove 321 is arranged on the convex column 32 circularly, the edge of the opening 471 near the axial damper 42 is clamped in the second clamping groove 321, the elastic element 46 is arranged near the axial damper 42, and the elastic element 46 is elastically pressed between the connecter 43 and the fastener 47.

Likewise, a first slope 322 is circularly arranged on the top of the convex column 32 and above the first clamping groove 431, and the edge of the opening 471 near the axial damper 42 is provided with a second slope 454 sliding fit with the first slope 322. In this way, it is more laborsaving to insert the inserting column 41.

In this example, the installation structure of the elastic element 46 is: a step is arranged at one end of the connector 43 near the axial damper 42, one end of the elastic element 46 presses against the step and the other end of the elastic element 46 presses against one end of the fastener 47. Likewise, in this example, the elastic element 46 is a spring.

In this example, when inserting the toilet cover plate 20, insert the inserting columns 41 on two sets of pivot shafts 40 into the embedding holes 31 of the corresponding convex columns 32 downwards respectively; when the inserting column is inserted into a proper location, the edge of the opening 471 of each fastener 47 near the axial damper 42 is clamped in the second clamping groove 321, then the toilet cover plate 20 can be reliably secured on the toilet body 10. When it is needed to disassemble the toilet cover plate 20, press the button 49 on the two sets of pivot shafts 40 respectively, then the button 49 moves to push against the fastener 47 so that the edge of the opening 471 of the fastener 47 near the axial damper 42 leaves the second clamping groove 321, then it is only needed to lift up the toilet cover plate 20, with convenient disassembly.

The above are the preferred embodiments of the disclosure merely and are not intended to limit the disclosure. Any modification, equivalent substitute and improvement made within the spirit and principle of the disclosure are intended to be included within the scope of protection of the disclosure.

What is claimed is:

1. A toilet convenient to assemble and disassemble, comprising a toilet body of which the upper end is provided with a supporting seat and a toilet cover plate of which the rear end is provided with a pivot shaft, wherein the supporting seat is provided with an embedding hole and the pivot shaft is provided with an inserting column, the inserting column is embedded into the embedding hole, wherein the pivot shaft comprises an axial damper arranged horizontally, a connector coaxially connected with the axial damper, a locking component, and a shell body arranged to place the connector and the locking component, the inserting column is arranged on the connector vertically and penetrates out from the shell body, and the inserting column is locked and secured in the embedding hole through the locking component; and wherein the locking component comprises a locking button and an elastic element, a first clamping groove is arranged on the top of the connector horizontally, a clamping hook capable of being clamped in the first clamping groove is arranged on the top of the locking button horizontally, a slot is arranged on the bottom of the connector horizontally, a leg extending into the slot is arranged on the bottom of the locking button horizontally, a through hole is arranged on the leg vertically, the inserting column extends out from the through hole, a convex column is arranged on the supporting seat, the embedding hole is arranged on the convex column, a second clamping groove is arranged on the convex column circularly, the edge of the through hole near the axial damper is clamped in the second clamping groove, and the elastic element is arranged between the connector and the locking button.

2. The toilet convenient to assemble and disassemble according to claim 1, wherein a first slope is circularly arranged on the top of the convex column and above the first clamping groove, and the edge of the through hole near the axial damper is provided with a second slope sliding fit with the first slope.

3. The toilet convenient to assemble and disassemble according to claim 1, wherein a mounting hole is arranged at one end of the connector far away from the axial damper, one end of the locking button is inserted into the mounting hole, the other end of the locking button penetrates the shell body, a mounting column is arranged at the center of the mounting hole convexly, a fixed hole corresponding to the mounting column is arranged at one end of the locking button located in the mounting hole, one end of the elastic element is sleeved in the mounting column and the other end of the elastic element is placed in the fixed hole.

4. The toilet convenient to assemble and disassemble according to claim 1, wherein the elastic element is a spring.

* * * * *